US012601105B2

(12) United States Patent
Masters, Jr.

(10) Patent No.: US 12,601,105 B2
(45) Date of Patent: Apr. 14, 2026

(54) DRYER ECO CYCLE CONTROL ALGORITHM

(71) Applicant: WHIRLPOOL CORPORATION, Benton Harbor, MI (US)

(72) Inventor: Roy E. Masters, Jr., St. Joseph, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 707 days.

(21) Appl. No.: 18/160,707

(22) Filed: Jan. 27, 2023

(65) Prior Publication Data

US 2024/0254684 A1 Aug. 1, 2024

(51) Int. Cl.

| | |
|---|---|
| ***D06F 58/38*** | (2020.01) |
| ***D06F 103/32*** | (2020.01) |
| ***D06F 103/34*** | (2020.01) |
| ***D06F 105/28*** | (2020.01) |
| ***D06F 105/56*** | (2020.01) |

(52) U.S. Cl.

CPC ..... *D06F 58/38* (2020.02); *D06F 2103/32* (2020.02); *D06F 2103/34* (2020.02); *D06F 2105/28* (2020.02); *D06F 2105/56* (2020.02)

(58) Field of Classification Search

CPC .. D06F 58/38; D06F 2103/34; D06F 2103/32; D06F 2105/28; D06F 2105/2105; D06F 2105/56

USPC ..... 34/527, 595–610

See application file for complete search history.

(56) References Cited

U.S. PATENT DOCUMENTS

| | | | | |
|---|---|---|---|---|
| 7,458,171 | B1 * | 12/2008 | Lentz | D06F 58/206 34/595 |
| 8,601,717 | B2 * | 12/2013 | Beers | D06F 58/206 34/550 |
| 9,206,543 | B2 | 12/2015 | Morin et al. | |
| 9,487,910 | B2 * | 11/2016 | Huang | D06F 58/206 |
| 9,670,612 | B2 * | 6/2017 | Lee | D06F 58/38 |
| 10,494,756 | B2 * | 12/2019 | Beers | D06F 58/10 |
| 10,557,229 | B2 | 2/2020 | Yu et al. | |
| 10,808,351 | B1 | 10/2020 | Flachsbart et al. | |
| 10,900,164 | B2 * | 1/2021 | Seok | D06F 58/48 |
| 10,995,449 | B2 | 5/2021 | Pattarrello et al. | |

(Continued)

FOREIGN PATENT DOCUMENTS

| | | | | |
|---|---|---|---|---|
| DE | 102011078916 | A1 | 1/2013 | |
| EP | 2710315 | B1 * | 3/2017 | D06F 58/266 |
| WO | WO-2012161889 | A1 * | 11/2012 | D06F 58/266 |

*Primary Examiner* — Stephen M Gravini

(74) *Attorney, Agent, or Firm* — BROOKS KUSHMAN P.C.

(57) ABSTRACT

A duty cycle heating portion of a drying cycle is initiated, in which a heating element of the clothes dryer is cycled on and off. An average baseline value is established for one or more of peak exhaust temperature of exhaust temperature of the clothes dryer or peak evaporation rate of evaporation rate of the clothes dryer. The duty cycle heating portion is continued until a peak delta between current exhaust temperature or the evaporation rate and the average baseline value exceeds a predefined threshold difference. The dryer transitions from the duty cycle heating portion to a continuous heating portion of the drying cycle, in which the heating element of the clothes dryer is continuously powered. The heating element is disengaged responsive to one or more criteria indicating completion of the drying cycle.

20 Claims, 7 Drawing Sheets

(56) References Cited

U.S. PATENT DOCUMENTS

| | | | | |
|---|---|---|---|---|
| 11,885,536 | B2 * | 1/2024 | Ko | D06F 58/38 |
| 12,234,599 | B2 * | 2/2025 | Lee | D06F 58/206 |
| 12,428,775 | B2 * | 9/2025 | Wu | D06F 95/00 |
| 2007/0124953 | A1 | 6/2007 | Crnkovich | |
| 2012/0291304 | A1 * | 11/2012 | Wisherd | F26B 11/0495 34/255 |
| 2018/0245276 | A1 | 8/2018 | Borden | |
| 2019/0330792 | A1 | 10/2019 | Del Maschio et al. | |
| 2021/0395941 | A1 | 12/2021 | McGrane et al. | |
| 2024/0254684 | A1 * | 8/2024 | Masters, Jr. | D06F 58/38 |
| 2025/0034793 | A1 * | 1/2025 | Heo | D06F 58/22 |
| 2025/0051998 | A1 * | 2/2025 | Ryoo | D06F 58/48 |

* cited by examiner

DRYER ECO CYCLE CONTROL ALGORITHM

TECHNICAL FIELD

Disclosed herein are aspects of a dryer cycle control algorithm for controlling a clothes dryer implementing a heater duty cycle.

BACKGROUND

Automatic clothes dryers typically comprise a cabinet enclosing a horizontally rotating drum. The drum may be accessible through an access door at the front of the cabinet and may hold clothing items to be dried. Rotation of the drum is driven by a motor. The motor can also drive a blower or fan which delivers dry, heated or unheated air to the drum for drying the clothing items. Alternatively, the blower can be driven by a separate motor. A heater is typically positioned in an air inlet assembly upstream of the drum for heating the drying air prior to its entry into the drum. The blower exhausts humid air from the drum through an exhaust outlet assembly to a discharge location exterior of the cabinet. Typically, the exhaust outlet assembly comprises a flexible conduit fabricated of wire-reinforced plastic or segmented metal installed between the cabinet and the discharge location.

SUMMARY

In one or more illustrative examples, a method of operating a clothes dryer by a controller includes initiating a duty cycle heating portion of a drying cycle, in which a heating element of the clothes dryer is cycled on and off; establishing an average baseline value for one or more of peak exhaust temperature of exhaust temperature of the clothes dryer or peak evaporation rate of evaporation rate of the clothes dryer; continuing the duty cycle heating portion until a peak delta between current exhaust temperature or the evaporation rate and the average baseline value exceeds a predefined threshold difference; transitioning from the duty cycle heating portion to a continuous heating portion of the drying cycle, in which the heating element of the clothes dryer is continuously powered; and disengaging the heating element responsive to one or more criteria indicating completion of the drying cycle.

In one or more illustrative examples, a clothes dryer, includes a controller, in communication with inlet and outlet temperature sensors, inlet and outlet humidity sensors, and a heating element. The controller is configured to initiate a duty cycle heating portion of a drying cycle, in which a heating element of the clothes dryer is cycled on and off; establish an average baseline value for one or more of peak exhaust temperature of exhaust temperature of the clothes dryer or peak evaporation rate of evaporation rate of the clothes dryer; continue the duty cycle heating portion until a peak delta between current exhaust temperature or the evaporation rate and the average baseline value exceeds a predefined threshold difference; transition from the duty cycle heating portion to a continuous heating portion of the drying cycle, in which the heating element of the clothes dryer is continuously powered; and disengage the heating element responsive to one or more criteria indicating completion of the drying cycle.

In one or more illustrative examples, non-transitory computer readable medium includes instructions that, when executed by a controller of clothes dryer having a inlet and outlet temperature sensors, inlet and outlet humidity sensors, and a heating element, cause the controller to perform operations including to initiate a duty cycle heating portion of a drying cycle, in which a heating element of the clothes dryer is cycled on and off; establish an average baseline value for one or more of peak exhaust temperature of exhaust temperature of the clothes dryer or peak evaporation rate of evaporation rate of the clothes dryer; continue the duty cycle heating portion until a peak delta between current exhaust temperature or the evaporation rate and the average baseline value exceeds a predefined threshold difference; transition from the duty cycle heating portion to a continuous heating portion of the drying cycle, in which the heating element of the clothes dryer is continuously powered; and disengage the heating element responsive to one or more criteria indicating completion of the drying cycle.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

Figure 1:
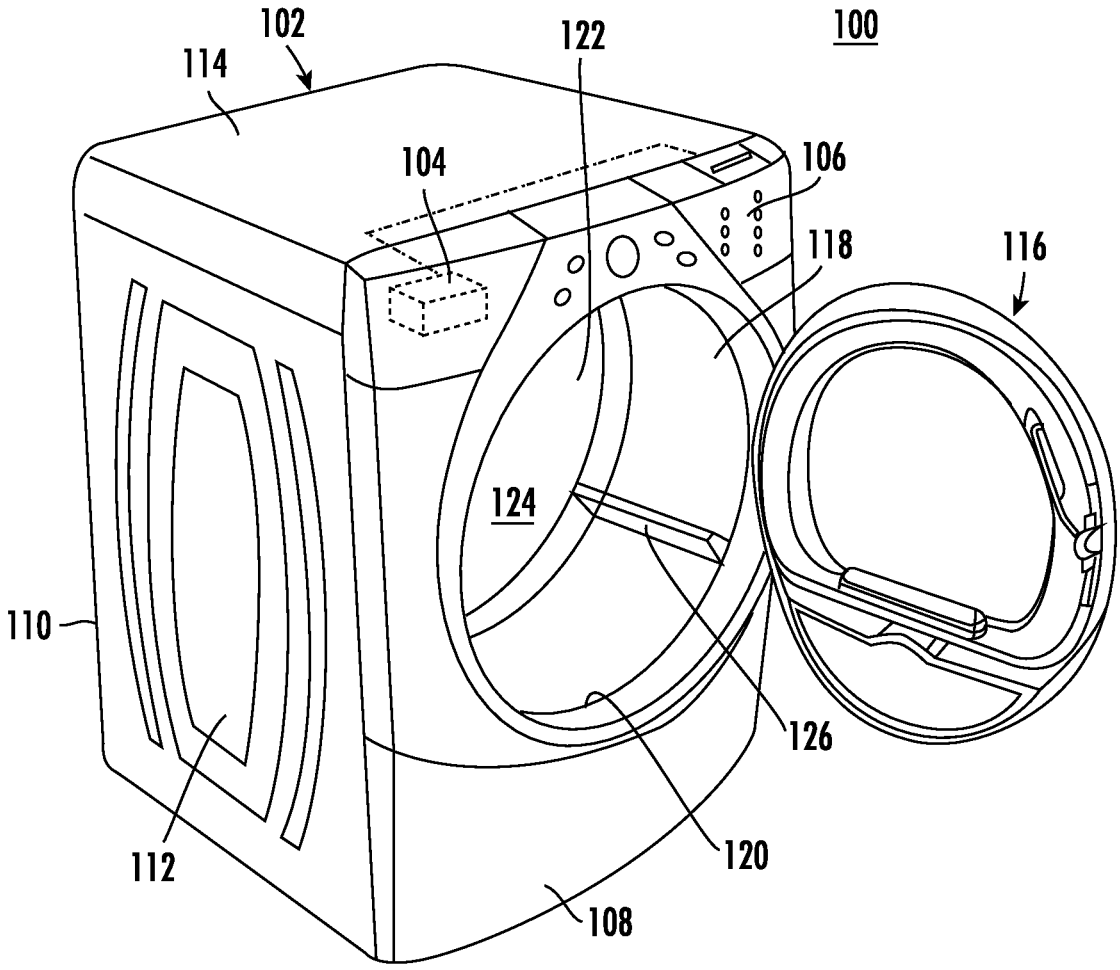
FIG. 1 illustrates an example front perspective view of a clothes dryer, wherein the clothes dryer may be controlled according to aspects of the present disclosure.

As required, detailed embodiments of the present disclosure are disclosed herein; however, it is to be understood that the disclosed embodiments are merely exemplary of the disclosure that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

The original energy test requirements for the United States (US) Department of Energy (DOE) were achievable by running a heater continuously and terminating using time or a moisture strip sensing system. More recent energy requirements have pushed designs to cycle the heater at a duty cycle far below 100%. In an example implementation, the heater may be cycled 20% "on", with a 6-minute cycle period. This may be repeated for a fixed amount of time, at which the heater is left on until end of cycle is achieved.

By replacing the moisture strips with more accurate humidity sensors, the appliance may be able to provide a more efficient control algorithm for ecological (ECO) cycles, since the cycling of the heaters affects the shape and level of the sensor signals. Cycling the heater increases the cycle time substantially and creates noise in the temp and humidity signals which complicate the ability to sense dryness level. Yet, trends in the local minima and maxima may be tracked for determining when to stop the cycling of the heater and keep the power on and also when to terminate the cycle.

A controller of the dryer appliance may implement a control algorithm that utilizes peak and amplitude signals to efficiently control dryer operation using a cycled heater implementation. The controller may, during cycle startup determine the heater input voltage and estimate mass flow, e.g., using drum inlet temp ramp rate and voltage function.

During an early portion of the dryer cycle (e.g., the first few duty cycles, the first 10-15 minutes, etc.), the controller may establish an average of the exhaust temperature peaks as well as establish an average of the evaporation rate peaks (e.g., from humidity signals and an airflow estimate).

The controller may continue the dryer cycle with heater cycling control until thresholds are met to indicate that the residual moisture content (RMC) is approaching a threshold (e.g., 6-7%) where full heater power is needed to dry to completion (e.g., below 2%). These thresholds for transitioning to full dry may include the peak exhaust temperature meeting a threshold or value range, and/or the peak evaporation rate meeting a threshold or value range.

Responsive to the threshold(s) being met, the controller may operate the heater continuously until the dryness threshold is achieved to reach the end of the dryer cycle. This may include, for instance, the exhaust temperature having achieved the target (e.g., the 2% as noted above), and/or the evaporation rate having dropped to meet a threshold or value range. Further aspects of the disclosure are discussed in detail herein.

FIG. 1 illustrates one embodiment of a clothes dryer 100 according to aspects of the present disclosure. While the laundry treating appliance is illustrated as a front-loading dryer, the laundry treating appliance according to aspects of the present disclosure may be another appliance which performs a cycle of operation on laundry, non-limiting examples of which include a combination washing machine and dryer; a tumbling or stationary refreshing/revitalizing machine; an extractor; a non-aqueous washing apparatus; and a revitalizing machine.

As illustrated in FIG. 1, the clothes dryer 100 may include a cabinet 102 in which is provided a controller 104 that may receive input from a user through a user interface 106 for selecting a cycle of operation and controlling the operation of the clothes dryer 100 to implement the selected cycle of operation. The clothes dryer 100 will offer the user a number of pre-programmed cycles of operation to choose from, and each pre-programmed cycle of operation may have any number of adjustable cycle modifiers. Examples of such modifiers include, but are not limited to chemistry dispensing, load size, a load color, and/or a load type.

The cabinet 102 may be defined by a chassis or frame supporting a front wall 108, a rear wall 110, and a pair of side walls 112 supporting a top wall 114. A door 116 may be hingedly mounted to the front wall 108 and may be selectively moveable between opened and closed positions to close an opening in the front wall 108, which provides access to the interior of the cabinet 102.

A rotatable drum 118 may be disposed within the interior of the cabinet 102 between opposing front bulkhead 120 and rear bulkhead 122, which collectively define a treating chamber 124 having an open face that may be selectively closed by the door 116. The front bulkhead 120 and/or the rear bulkhead 122 may be formed of stamped aluminum or metal in some examples, or as a molded plastic component in other examples. The drum 118 may include at least one baffle or lifter 126. In most clothes dryers 100, there are multiple lifters 126. The lifters 126 may be located along the inner surface of the drum 118 defining an interior circumference of the drum 118. The lifters 126 may facilitate movement of laundry within the drum 118 as the drum 118 rotates.

Figure 2:
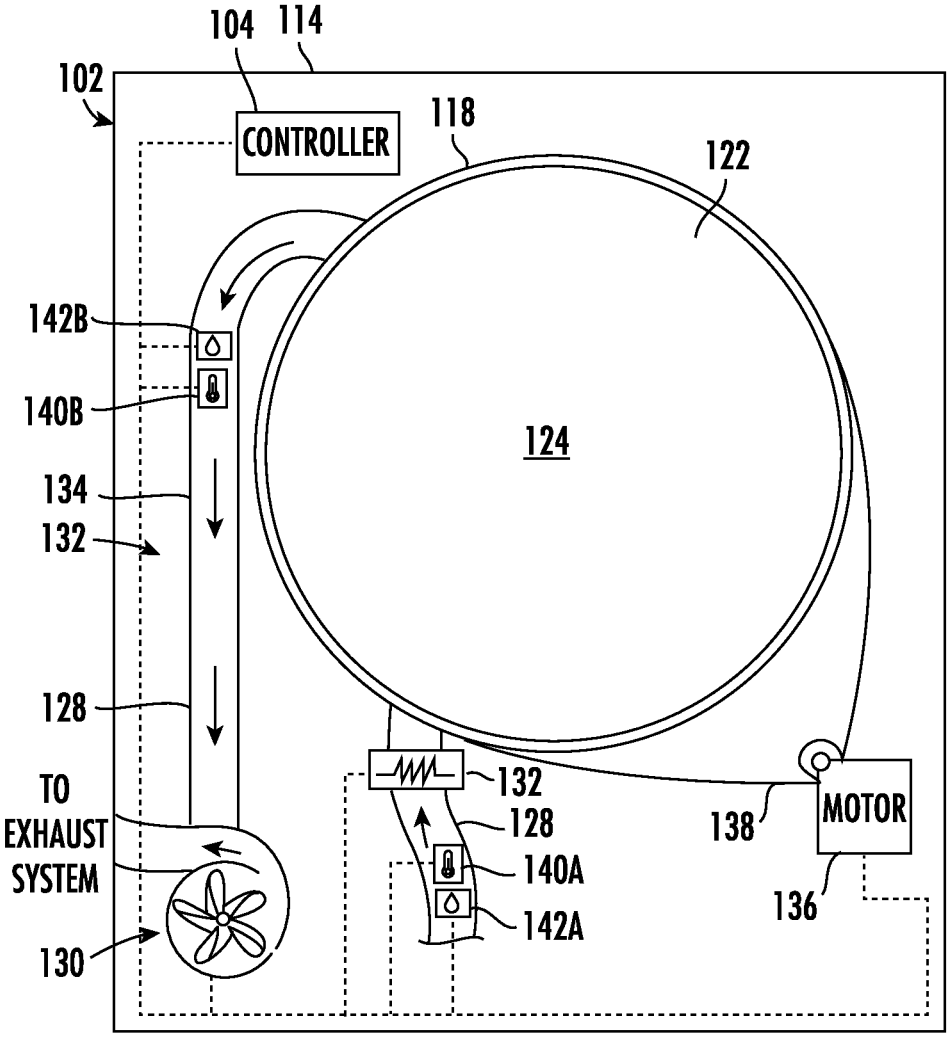
FIG. 2 illustrates an example front schematic view of the clothes dryer of FIG. 1.

Referring to FIG. 2, an air flow system for the clothes dryer 100 is schematically illustrated and supplies air to the treating chamber 124 and then exhausts air from the treating chamber 124. The air flow system may have an air supply portion that may be formed in part by a supply air conduit 128, which has one end open to the ambient air and another end fluidly coupled to the treating chamber 124. For instance, the supply air conduit 128 may couple with the treating chamber 124 through an inlet formed in the rear bulkhead 122. A heater 132 may be provided within the supply air conduit 128 and may be operably coupled to and controlled by the controller 104. If the heater 132 is cycled on, the supplied air may be heated prior to entering the drum 118. The air supply system may further include an air exhaust portion that may be formed in part by an exhaust air conduit 134. A fan 130 may be provided within the exhaust air conduit 134. Operation of the fan 130 draws air into the treating chamber 124 by the supply air conduit 128 and exhausts air from the treating chamber 124 through the exhaust air conduit 134. The exhaust air conduit 134 may be fluidly coupled with a household exhaust duct (not shown) for exhausting the air from the treating chamber 124 to the outside environment. Other air flow systems are possible as well. For example, the fan 130 may be located in the supply air conduit 128 instead of in the exhaust air conduit 134 (not shown).

The clothes dryer 100 may also be provided with temperature sensors 140. The temperature sensors 140 may include an inlet temperature sensor 140A and an outlet temperature sensor 140B. One example of a temperature sensor 140 is a thermocouple. The temperature sensors 140 may be operably coupled to the controller 104 such that the controller 104 receives output from temperature sensors 140A, 140B. The clothes dryer 100 may also be provided with humidity sensors 142. Similarly, the humidity sensors 142 may include an inlet humidity sensors 142A and an outlet humidity sensor 142B. The humidity sensors 142 may be operably coupled to the controller 104 such that the controller 104 receives output from the humidity sensors 142.

The inlet temperature sensor 140A and the inlet humidity sensor 142A may be arranged inside or near the supply air conduit 128. The inlet temperature sensor 140A may be used to determine the temperature of the incoming air (before heating), while the inlet humidity sensor 142A may similarly be used to determine the humidity of the incoming air.

The outlet temperature sensor 140B and the outlet humidity sensor 142B may be mounted at any location after the drum 118 and before the home exhaust connection, such as in or near the exhaust air conduit 134 of the clothes dryer 100. For example, the temperature sensor 140B and the outlet humidity sensor 142B may be located within or around the area of the exhaust air conduit 134. The temperature sensor 140B may sense the temperature of the exhaust air flow, while the outlet humidity sensor 142B may sense the humidity of the exhaust air flow.

The drum 118 may be rotated by a suitable drive mechanism, which is illustrated as a motor 136 and a coupled belt 138. The motor 136 may be operably coupled to the controller 104 to control the rotation of the drum 118 to complete a cycle of operation. Other drive mechanisms, such as direct drive, may also be used.

Figure 3:
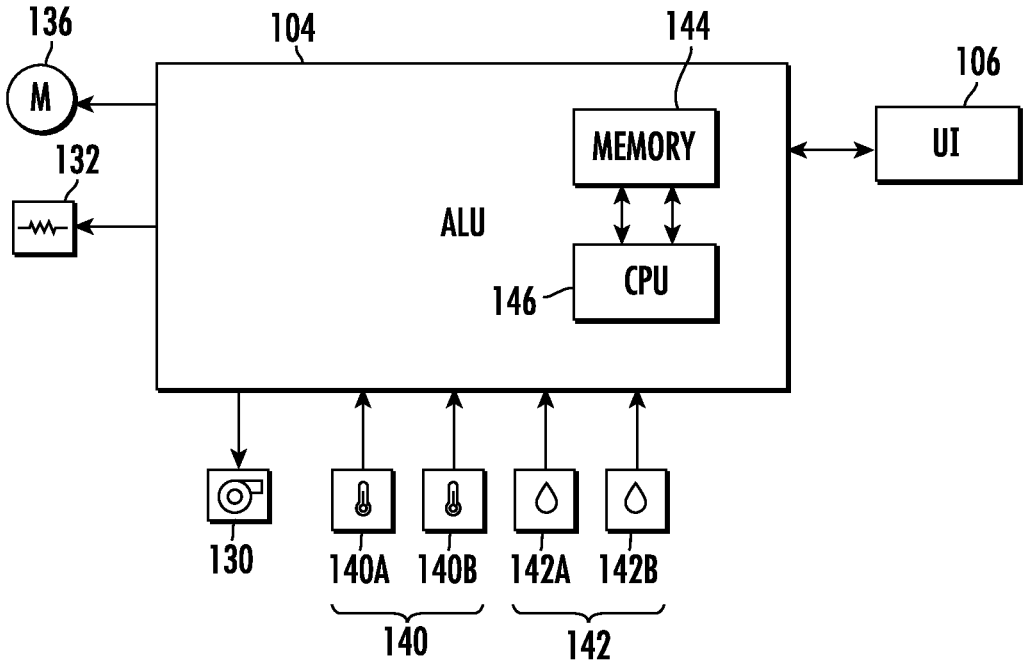
FIG. 3 illustrates an example schematic representation of a controller for controlling the operation of one or more components of the clothes dryer of FIG. 1.

As illustrated in FIG. 3, the controller 104 may be provided with a memory 144 and a central processing unit (CPU) 146. The memory 144 may be used for storing the control software that may be executed by the CPU 146 in completing a cycle of operation using the clothes dryer 100 and any additional software. The memory 144 may also be used to store information, such as a database or table, and to store data received from the one or more components of the clothes dryer 100 that may be communicably coupled with the controller 104.

The controller 104 may be operably coupled with one or more components of the clothes dryer 100 for communicating with and/or controlling the operation of the component to complete a cycle of operation. For example, the controller 104 may be coupled with the fan 130 and the heater 132 for controlling the temperature and flow rate of the air flow through the treating chamber 124; the motor 136 for controlling the direction and speed of rotation of the drum 118; the temperature sensors 140A, 140B for receiving information about the temperature of the intake and exhaust air flows; the humidity sensors 142A, 142B for receiving information about the humidity of the intake and exhaust air flows; and the user interface 106 for receiving user selected inputs and communicating information to the user.

The controller 104 may also receive input from various other additional sensors, which are not shown for simplicity. Non-limiting examples of additional sensors that may be communicably coupled with the controller 104 include: an air flow rate sensor, a weight sensor, and a motor torque sensor.

Generally, in normal operation of the clothes dryer 100, a user first selects a cycle of operation via the user interface 106. The user may also select one or more cycle modifiers. In accordance with the user-selected cycle and cycle modifiers, the controller 104 may control the operation of the rotatable drum 118, the fan 130 and the heater 132, to implement the cycle of operation to dry the laundry. When instructed by the controller 104, the motor 136 rotates the drum 118 via the belt 138. The fan 130 draws air through the supply air conduit 128 and into the treating chamber 124, as illustrated by the flow vectors. The air may be heated by the heater 132. Air may be vented through the exhaust air conduit 134 to remove moisture from the treating chamber 124. During the cycle, treating chemistry may be dispensed into the treating chamber 124. Also during the cycle, output generated by the temperature sensors 140A, 140B and the humidity sensors 142A, 142B may be utilized to generate digital data corresponding to sensed operational conditions inside the treating chamber 124. The output may be sent to the controller 104 for use in calculating operational conditions inside the treating chamber 124, or the output may be indicative of the operational condition. Once the output is received, the controller 104 processes the output for storage in the memory 144. The controller 104 may convert the output during processing such that it may be properly stored in the memory 144 as digital data. The stored digital data may be processed in a buffer memory, and used, along with pre-selected coefficients, in algorithms to electronically calculate various operational conditions, such as a degree of wetness or moisture content of the laundry. The controller 104 may use both the cycle modifiers specified by the user and the additional information obtained by the sensors 140A-140B and 142A-142B to carry out the desired cycle of operation.

The previously described clothes dryer 100 provides the structure for the implementation of aspects of the present disclosure. Several embodiments of the method will now be described in terms of the operation of the clothes dryer 100. The embodiments of the method function embody the improved control algorithm that utilizes peak and amplitude signals to efficiently control dryer operation using a cycled heater 132 implementation.

Figure 4A:
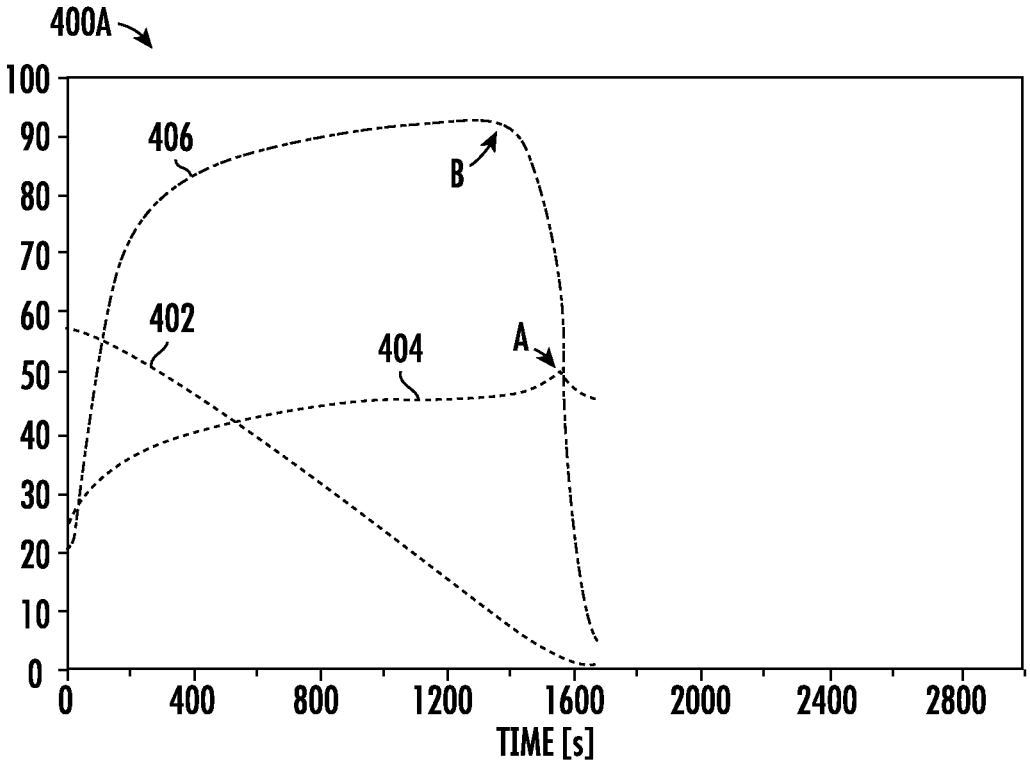
FIG. 4A illustrates an example graph of a dryer cycle without cycling of the heater.

FIG. 4A illustrates an example graph 400A of a dryer cycle without cycling of the heater 132. In the graph 400A, the X-Axis represents time, while the Y-Axis represents a scale from 1 to 100. Three traces are shown: RMC 402, exhaust temperature 404, and evaporation rate 406. The exhaust temperature 404 may be measured using the temperature sensor 140B, and the RMC 402 may be inferred using the humidity sensor 142B. The evaporation rate 406 may be estimated based on factors such as initial moisture content of the load, weight of the load, expected final moisture, drying air temperature, air velocity, humidity levels, etc. For instance, a data table such as a psychrometric chart may be used to aid in computing the evaporation rate 406.

More specifically, absolute humidity may be computed as the ratio of $$\frac{\text{Kg of } H_2O}{\text{Kg of Dry Air}}.$$

Thus, the signals from the inlet temperature sensor 140A and from the inlet humidity sensor 142A may be used to calculate inlet absolute humidity. Similarly, the signals from the outlet temperature sensor 140B and from the outlet humidity sensor 142B may be used to calculate outlet absolute humidity. The evaporation rate 406 (e.g., in units of $$\frac{\text{Kg } H_2O}{S})$$

may be computed as the dryer mass flow rate (e.g., in units of $$\frac{\text{Kg}}{S}$$

of Moist Air)·(outlet absolute humidity−inlet absolute humidity).

The RMC 402 may be seen to decrease from approximately 57.5% down to approximately 2%. The exhaust temperature 404 may increase until reaching a set point, shown at (A). The evaporation rate 406 may increase until an inflection point nearer the end of the cycle and may then reduce, as shown at (B). Thus, the end of cycle may be indicated by one or both of: the temperature trip point which happens near the end of cycle, and/or the evaporation signal where the rate drops rapidly near the end of cycle.

Figure 4B:
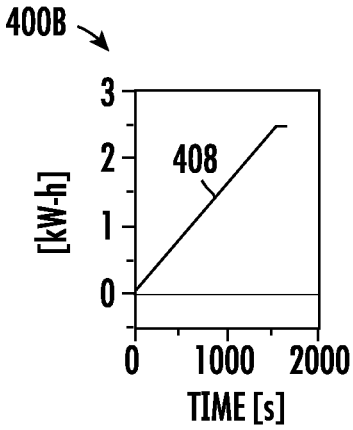
FIG. 4B illustrates an example graph of power consumption of the heater over the dryer cycle illustrated in FIG. 4A.

FIG. 4B illustrates an example graph 400B of power consumption of the heater 132 over the dryer cycle illustrated in FIG. 4A. In the graph 400B, the X-Axis represents time, while the Y-Axis represents k Wh. A trace is shown illustrating cumulative power usage 408 of the heater 132 over the cycle shown in FIG. 4A. As can be seen, power usage grows linearly from zero until the conclusion of the drying cycle.

Figure 5A:
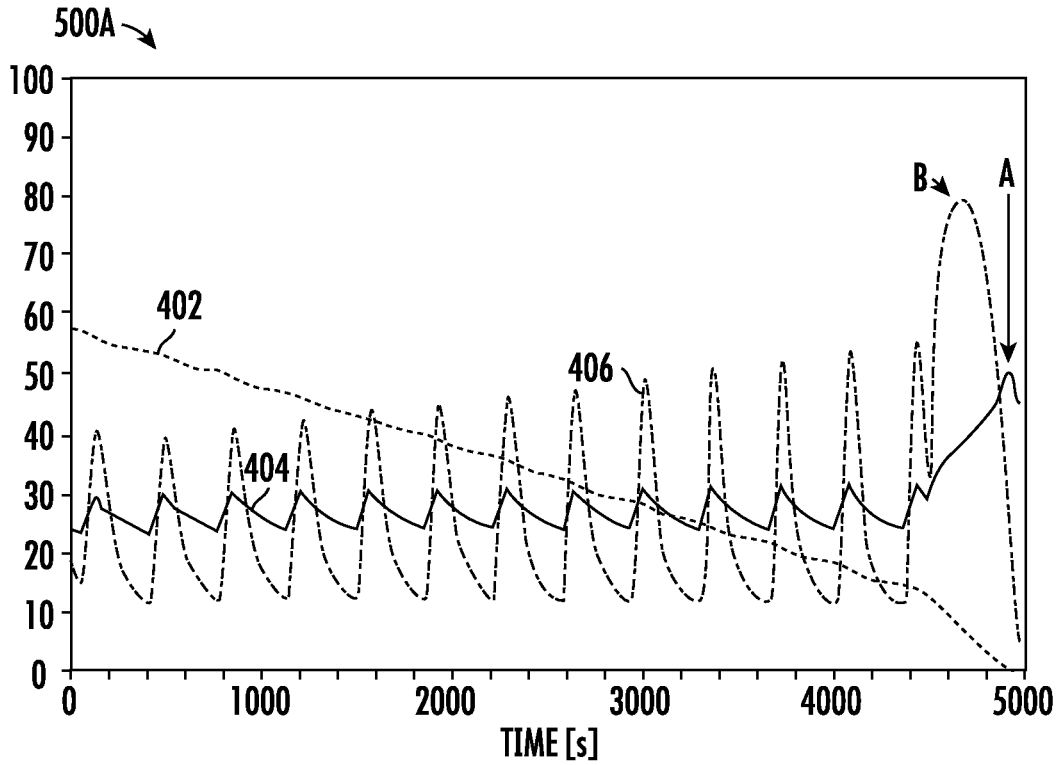
FIG. 5A illustrates an example graph of a dryer cycle using a 20% duty cycle of the heater.

FIG. 5A illustrates an example graph 500A of a dryer cycle using a 20% duty cycle of the heater 132. In the graph 500A, the X-Axis represents time, while the Y-Axis represents a scale from 1 to 100. Again the same three traces are shown: RMC 402, exhaust temperature 404, and evaporation rate 406. The RMC 402 may be seen to decrease from approximately 57.5% down to approximately 2%.

The 20% duty cycle is performed for approximately 4500 seconds, after which the power to the heater 132 remains on continuously. The period of power cycling of the exhaust temperature 404 is apparent in the graph 500A, as is the resultant cycles of evaporation rate 406 that increase when the heater 132 is engaged and that reduce when the heater 132 is disengaged. Additionally, the RMC 402 may be seen to reduce at a greater rate when the heater 132 is engaged as compared to the portions of the duty cycle where the heater 132 is disengaged. It can further be seen that the cycling pattern concludes once the heater 132 is continuously powered, which stays powered until drying is achieved.

Figure 5B:
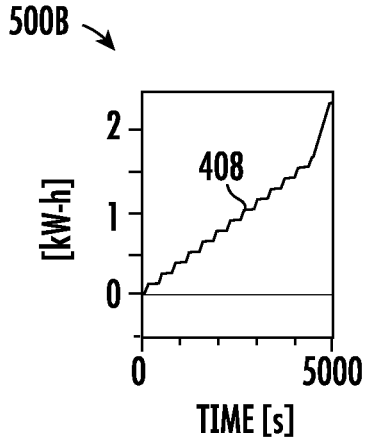
FIG. 5B illustrates an example graph of power consumption of the heater over the dryer cycle illustrated in FIG. 5A.

FIG. 5B illustrates an example graph 500B of power consumption of the heater 132 over the dryer cycle illustrated in FIG. 5A. In the graph 500B, the X-Axis represents time, while the Y-Axis represents k Wh. A trace is shown illustrating cumulative power usage 408 of the heater 132 over the cycle shown in FIG. 5A. As can be seen, power usage initially grows stepwise with the cycling of the heater 132, and then grows linearly once the heater 132 is continuously powered, until the conclusion of the drying cycle.

Referring to FIG. 5A in comparison to FIG. 4A, the time to reach 2% RMC 402 using the 25% duty cycle is far greater. Referring to FIG. 4A, the dryer cycle completes before 1700 seconds, while in FIG. 5A, the dryer cycle requires almost 5000 seconds to complete. In addition to increasing the cycle time substantially, cycling the heater 132 also creates noise in the exhaust temperature 404 and humidity sensor 142 signals which complicate the ability to sense dryness level.

Figure 6:
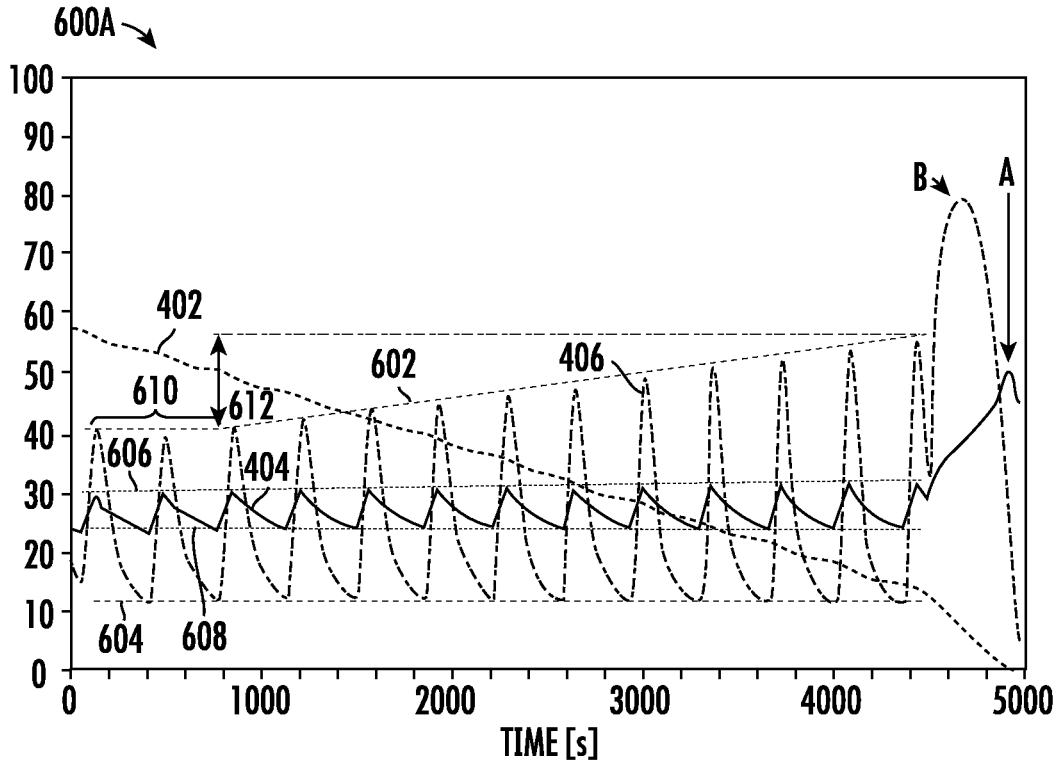
FIG. 6 illustrates an example graph of peak exhaust temperature and peak evaporation rate signals for the duty cycle operation of the heater of FIG. 5A.

FIG. 6 illustrates an example graph 600 of peak evaporation rate 602 and peak exhaust temperature 606 signals for the duty cycle operation of the heater 132 of FIG. 5A. As shown, the peak evaporation rate 602 is a trendline connecting the maxima in the evaporation rate 406 trace. Additionally, a trough evaporation rate 604 is a trendline illustrated as connecting the minima in the evaporation rate 406 trace. Similarly, peak exhaust temperature 606 is a trendline illustrated as connecting the maxima in the exhaust temperature 404 trace, while trough exhaust temperature 608 is a trendline illustrated as connecting the minima in the exhaust temperature 404 trace.

Trends in the peak evaporation rate 602 and/or the peak exhaust temperature 606 may be used to determine when to transition from heater 132 cycling to continuous powering of the heater 132. Additionally, these trends may be used to determine when to terminate the dryer cycle.

The controller 104 may consider the peak values of the peak evaporation rate 602 and the peak exhaust temperature 606 by establishing a baseline value 610 near the beginning of the cycle. This establishment of the baseline value 610 may be performed, in an example, by averaging the first few peaks of the evaporation rate 406 (e.g., the first two or three peaks, peaks over a predefined initial time period, etc.), depending on cycling frequency.

The controller 104 may further track or otherwise measure the change in the peak exhaust temperature 606 from the baseline value 610 as the cycle progresses to an evaporation rate difference 612 to signal when to start the heater 132 at 100% duty cycle until cycle termination. This evaporation rate difference 612 may be defined as a pre-determined value that correlates to the RMC 402. An optimized energy result may be achieved by cycling the heater 132 until approximately 7-10% RMC 402 before turning on the heater 132 to drive the moisture content below the equilibrium RMC 402 of approximately 6.3%. As shown, the heater 132 is transitioned from cycled operation to continuous operation responsive to the peak evaporation rate 602 reaching the evaporation rate difference 612.

It should be noted that, while not as great a difference as scaled in the graph 600, a similar trend exists for the peak exhaust temperature 606. The peak exhaust temperature 606 also may have a baseline which may be measured at the beginning of the cycle and may measurably increase during the cycle to be similarly used as a trigger, e.g., once the peak exhaust temperature 606 reaches at least a predetermined difference from the exhaust temperature 404 baseline.

An example data table illustrating the robustness of the approach to airflow level is shown in Table 1.

TABLE 1

Change in Peak Evaporation Delta vs RMC vs Air Flow

| | (First three peaks) | | (Late-Start peak) | |
|---|---|---|---|---|
| Airflow CMH | Start Evap (gPM) | Late Peak | Peak Delta | RMC |
| Low | 40 | 50 | 10 | 24% |
| Low | 40 | 52 | 12 | 20% |
| Low | 40 | 55 | 15 | 15% |
| Low | 40 | 57 | 17 | 10% |
| Medium | 46 | 57 | 11 | 20% |
| Medium | 46 | 61 | 15 | 15% |
| Medium | 46 | 63 | 17 | 10% |
| High | 52 | 64 | 12 | 20% |
| High | 52 | 66 | 14 | 15% |
| High | 52 | 68 | 16 | 10% |

It should be noted that various factors may affect the level of peak and amplitude. For instance, the exhaust temperature 404 and evaporation rate 406 of the clothes dryer 100 may vary depending on one or more of: heater input voltage (e.g., affecting power input); vent length (e.g., affecting flow restriction) and fan design (e.g., affecting fan performance curve); clothes load type; clothes load size; clothes RMC; dryer platform (e.g., including design elements such as drum size, flow type, axial vs loop flow, etc.); temperature and humidity sensor location; and/or drum speed. Thus, these factors may be sampled, measured, retrieved, or otherwise retrieved by the controller 104 when performing a drying cycle.

Figure 7:
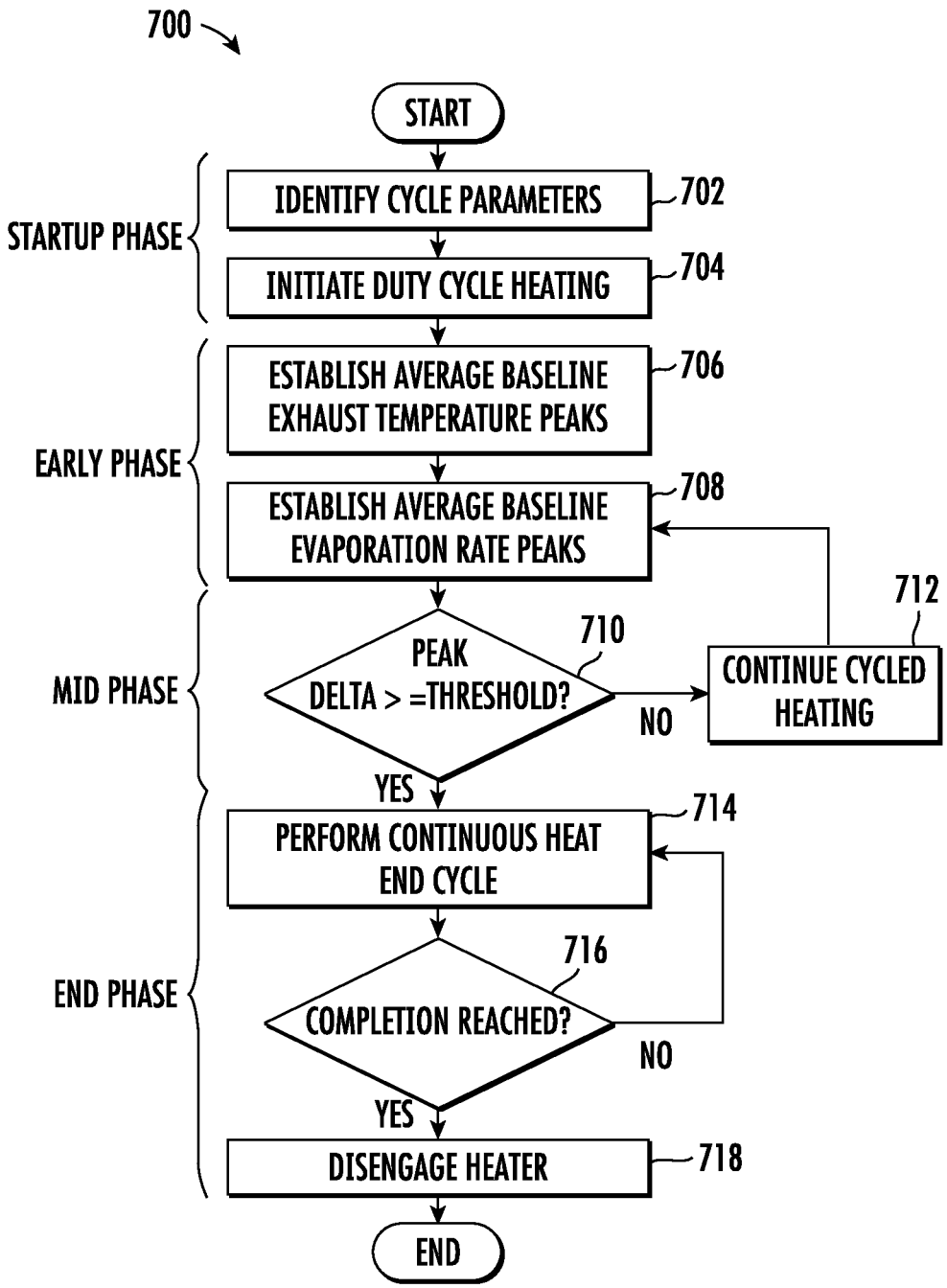
FIG. 7 illustrates an example process for controlling the clothes dryer implementing a heater duty cycle.

FIG. 7 illustrates an example process 700 for controlling the clothes dryer 100 implementing a duty cycle of the heater 132. In an example, the process 700 may be performed by the controller 104 in the context of the drying cycle for the clothes dryer 100 described in detail herein. As explained herein, the process 700 may include several phases: a startup phase in which parameters of a clothes dryer 100 cycle are identified and the duty cycle of the heater 132 is initiated, an early phase in which baseline values 610 to measure against are established, a mid-phase in which the heater 132 is operated with the duty cycle, and an end phase in which the heater 132 is operated with a continuous cycle until completion.

At operation 702, the controller 104 identifies cycle parameters. The controller 104 may identify one or more of heater input voltage (e.g., affecting power input); vent length (e.g., affecting flow restriction) and fan design (e.g., affecting fan performance curve); clothes load type; clothes load size; clothes RMC; dryer platform (e.g., including design elements such as drum size, flow type, axial vs loop flow, etc.); temperature and humidity sensor location; and/or drum speed. In an example, the controller 104 may estimate mass flow using a drum inlet temperature ramp rate and voltage function. One or more of these values may also be used to aid in estimating the evaporation rate 406 for the load.

At operation 704, the controller 104 initiates the duty cycle of the heater 132. In the illustrated examples, the duty cycle may be a 20% duty cycle, that is on for 20% of the time and the off for 80% of the time (e.g., on for one unit of time and off for the next four). It should be noted that this is only one example, and other duty cycles may be used, such as 10%, 25%, 30%, 40%, 50%, 60%, 70%, 75%, etc.

At operation 706, the controller 104 establishes the baseline value 610 for the peak exhaust temperature 606. In an example, the controller 104 may utilize the temperature sensor 140B to receive the exhaust temperature signal. The controller 104 may average the peak temperature measured for an initial set of duty cycles of the heater 132 (e.g., the first two or three cycles, the first 15 minutes of operation, etc.).

At operation 708, the controller 104 establishes the baseline value 610 for the peak evaporation rate 602. In an example, the controller 104 may compute the evaporation rate 406 for the initial set of duty cycles of the heater 132. For instance, the signals from the inlet temperature sensor 140A and from the inlet humidity sensor 142A may be used to calculate inlet absolute humidity, the signals from the outlet temperature sensor 140B and from the outlet humidity sensor 142B may be used to calculate outlet absolute humidity, and the evaporation rate 406 may be computed as the dryer mass flow rate·(outlet absolute humidity−inlet absolute humidity).

The controller 104 may average the peak rates measured for the initial set of duty cycles of the heater 132 (e.g., the first two or three cycles, the first 15 minutes of operation, etc.). In many examples, operations 706 and 708 are performed over the same set of initial cycles.

At operation 710, the controller 104 determines whether the peak delta exceeds the threshold difference amount to signify the end of the duty cycle portion of the clothes dryer 100 cycle. In an example, the controller 104 may monitor the peak evaporation rate 602 until a difference of the peak evaporation rate 602 to the baseline value 610 of the peak evaporation rate 602 exceeds a predefined evaporation rate difference 612. In an example, the controller 104 may additionally or alternatively monitor the peak exhaust temperature 606 until a difference of the peak exhaust temperature 606 to the baseline value of the peak exhaust temperature 606 exceeds a predefined temperature difference. If the peak delta of neither of the peak evaporation rate 602 or peak exhaust temperature 606 exceeds the corresponding threshold, control passes to operation 712. If the peak delta of the peak evaporation rate 602 or peak exhaust temperature 606 exceeds the corresponding threshold, control passes to operation 714.

At operation 712, the controller 104 continues cycling the heater 132 until one or more rate differences 612 are met. After operation 712, control returns to operation 710.

At operation 714, the controller 104 switches to continuous operation of the heater 132. At operation 716, the controller 104 determines whether the cycle completion is reached. In an example, the continuous operation of the heater 132 may continue for a predetermined period of time. In another example, the continuous operation of the heater 132 may continue until the exhaust temperature 404 reaches a set point, shown at (A) in FIG. 6. In yet a further example, the continuous operation of the heater 132 may continue until evaporation rate 406 reaches an inflection point where the evaporation rate 406 peaks and begins to decrease. If cycle completion is met, control proceeds to operation 716. Otherwise, control returns to operation 714 to remain in the continuous heating mode.

At operation 716, the controller 104 disengages the heater 132. At this point the heating for the cycle of the clothes dryer 100 is complete.

Thus, by taking advantage of the increased accuracy of humidity sensors 142 as compared to moisture strips, the controller 104 of the dryer appliance may implement a control algorithm that utilizes peak and amplitude signals to efficiently control dryer operation using a cycled heater 132 implementation.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

Computing devices described herein, such as the controller 104, generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, C #, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

What is claimed is:

1. A method of operating a clothes dryer by a controller, comprising:

initiating a duty cycle heating portion of a drying cycle, in which a heating element of the clothes dryer is cycled on and off;

establishing an average baseline value for one or more of peak exhaust temperature of exhaust temperature of the clothes dryer or peak evaporation rate of evaporation rate of the clothes dryer;

continuing the duty cycle heating portion until a peak delta between current exhaust temperature or the evaporation rate and the average baseline value exceeds a predefined threshold difference;

transitioning from the duty cycle heating portion to a continuous heating portion of the drying cycle, in which the heating element of the clothes dryer is continuously powered; and disengaging the heating element responsive to one or more criteria indicating completion of the drying cycle.

2. The method of claim 1, further comprising identifying cycle parameters at the outset of the drying cycle to allow for computation of the evaporation rate.

3. The method of claim 1, wherein the average baseline value is computed as an average of a plurality of initial peaks occurring at the beginning of the duty cycle heating portion.

4. The method of claim 1, further comprising measuring the exhaust temperature using a temperature sensor mounted in or near an exhaust air conduit of the clothes dryer.

5. The method of claim 1, further comprising:

computing intake absolute humidity using inlet temperature and humidity sensors, computing exhaust absolute humidity using outlet temperature and humidity sensors, measuring the evaporation rate according to mass flow of air through the clothes dryer and the intake and exhaust absolute humidities; and correlating residual moisture content (RMC) in the clothes dryer based on the evaporation rate and the exhaust temperature.

6. The method of claim 1, wherein the one or more criteria indicating the completion of the drying cycle includes the exhaust temperature reaching a set point temperature.

7. The method of claim 1, wherein the one or more criteria indicating the completion of the drying cycle includes the evaporation rate reaching an inflection point where the evaporation rate peaks and begins to decrease.

8. A clothes dryer, comprising:

a controller, in communication with inlet and outlet temperature sensors, inlet and outlet humidity sensors, and a heating element, configured to:

initiate a duty cycle heating portion of a drying cycle, in which a heating element of the clothes dryer is cycled on and off;

establish an average baseline value for one or more of peak exhaust temperature of exhaust temperature of the clothes dryer or peak evaporation rate of evaporation rate of the clothes dryer;

continue the duty cycle heating portion until a peak delta between current exhaust temperature or the evaporation rate and the average baseline value exceeds a predefined threshold difference;

transition from the duty cycle heating portion to a continuous heating portion of the drying cycle, in which the heating element of the clothes dryer is continuously powered; and disengage the heating element responsive to one or more criteria indicating completion of the drying cycle.

9. The clothes dryer of claim 8, wherein the controller is further configured to identify cycle parameters at the outset of the drying cycle to allow for computation of the evaporation rate.

10. The clothes dryer of claim 8, wherein the controller is further configured to compute the average baseline value as an average of a plurality of initial peaks occurring at the beginning of the duty cycle heating portion.

11. The clothes dryer of claim 8, wherein the temperature sensor is mounted in or near an exhaust air conduit of the clothes dryer.

12. The clothes dryer of claim 8, wherein the controller is further configured to:

measure the evaporation rate according to mass flow of air through the clothes dryer and intake and exhaust absolute humidity determined using the humidity sensors and the temperature sensors; and correlate residual moisture content (RMC) in the clothes dryer based on the evaporation rate and the exhaust temperature.

13. The clothes dryer of claim 8, wherein the one or more criteria indicating the completion of the drying cycle includes the exhaust temperature reaching a set point temperature.

14. The clothes dryer of claim 8, wherein the one or more criteria indicating the completion of the drying cycle includes the evaporation rate reaching an inflection point where the evaporation rate peaks and begins to decrease.

15. A non-transitory computer readable medium comprising instructions that, when executed by a controller of clothes dryer having a inlet and outlet temperature sensors, inlet and outlet humidity sensors, and a heating element, cause the controller to perform operations including to:

initiate a duty cycle heating portion of a drying cycle, in which a heating element of the clothes dryer is cycled on and off;

establish an average baseline value for one or more of peak exhaust temperature of exhaust temperature of the clothes dryer or peak evaporation rate of evaporation rate of the clothes dryer;

continue the duty cycle heating portion until a peak delta between current exhaust temperature or the evaporation rate and the average baseline value exceeds a predefined threshold difference;

transition from the duty cycle heating portion to a continuous heating portion of the drying cycle, in which the heating element of the clothes dryer is continuously powered; and disengage the heating element responsive to one or more criteria indicating completion of the drying cycle.

16. The non-transitory computer readable medium of claim 15, further comprising instructions that, when executed by the controller, cause the controller to perform operations including to identify cycle parameters at the outset of the drying cycle to allow for computation of the evaporation rate.

17. The non-transitory computer readable medium of claim 15, further comprising instructions that, when executed by the controller, cause the controller to perform operations including to compute the average baseline value as an average of a plurality of initial peaks occurring at the beginning of the duty cycle heating portion.

18. The non-transitory computer readable medium of claim 15, wherein the temperature sensor is mounted in or near an exhaust air conduit of the clothes dryer.

19. The non-transitory computer readable medium of claim 15, further comprising instructions that, when executed by the controller, cause the controller to perform operations including to:

measure the evaporation rate according to mass flow of air through the clothes dryer and intake and exhaust absolute humidity determined using the humidity sensors and the temperature sensors; and correlate residual moisture content (RMC) in the clothes dryer based on the evaporation rate and the exhaust temperature.

20. The non-transitory computer readable medium of claim 15, wherein the one or more criteria indicating the completion of the drying cycle includes one or more of:

the exhaust temperature reaching a set point temperature, or the evaporation rate reaching an inflection point where the evaporation rate peaks and begins to decrease.

* * * * *